United States Patent [19]

Thomas

[11] Patent Number: 4,604,502

[45] Date of Patent: Aug. 5, 1986

[54] JOYSTICK CONTROL

[76] Inventor: David S. Thomas, 29998 MacIntyre, Livonia, Mich. 48150

[21] Appl. No.: 751,888

[22] Filed: Jul. 5, 1985

[51] Int. Cl.[4] ..... H01H 25/00

[52] U.S. Cl. ..... 200/6 A; 200/157

[58] Field of Search ..... 200/6 A, 17 R, 18, 153 R, 200/157

[56] References Cited

U.S. PATENT DOCUMENTS

| | | | |
|---|---|---|---|
| 1,434,217 | 10/1922 | Ledwidge | 200/6 A |
| 2,471,841 | 5/1949 | Sells | 200/6 A |
| 2,849,548 | 8/1958 | Young | 200/6 A |
| 3,156,134 | 11/1964 | Forrester, Jr. | 200/6 A X |
| 3,293,381 | 12/1966 | Eitel | 200/6 A |
| 4,348,556 | 9/1982 | Gettig et al. | 200/6 A X |
| 4,470,320 | 9/1984 | Kim | 200/6 A X |
| 4,501,939 | 2/1985 | Hyltin et al. | 200/6 A |
| 4,520,242 | 5/1985 | Kopsho, Jr. | 200/6 A |
| 4,533,899 | 8/1985 | Isaksson | 200/6 A X |

*Primary Examiner*—J. R. Scott

*Attorney, Agent, or Firm*—H. Jay Spiegel

[57] ABSTRACT

Disclosed herein is an improved joy stick control including a control rod interrelated with four switches so as to enable the control of movements in eight different directions. In a further aspect, the present invention includes a fire button located below the switches associated with the control rod and above indentations formed in the handle for the fingers. Each of the switches associated with the control rod includes a stationary upper contact and a movable lower contact with the lower contacts of the switches being operatively connected to the control rod.

12 Claims, 4 Drawing Figures

JOYSTICK CONTROL

BACKGROUND OF THE INVENTION

The present invention relates to an improved joystick control. In the prior art, joystick controls are well known. Those joysticks known to applicant are extremely cumbersome in their design and require the control rod to be connected to a large control box which control box contains the associated switch elements. The following prior art is known to Applicant:

U.S. Pat. No. 4,297,542 to Shumway discloses a joystick device including a main housing 10 having a start button 20 and a joystick 16 movable with respect thereto. In Shumway, four switches are disclosed including respective contacts 86, 90, 94 and 98 which may be actuated either singly or doubly so as to enable the movement of a displayed object in any one of eight directions. Shumway discloses that the upper portions of the switches are moved by the pressure plate 24 to actuate the switches.

U.S. Pat. No. 4,439,648 to Reiner, et al. discloses a joystick type controller including switches 12 and wherein a pressure plate 22 integrally associated with the handle 20 bears upon the upper contacts of the switches 12 so as to actuate them.

U.S. Pat. No. 4,491,325 to Bersheim discloses a game control apparatus including a handle 11 having a trigger 12 and a push button 13 thereon and which actuates connecting rods 17 and 18 as well as control shaft 16, all of which are clearly seen to be below the handle 11.

U.S. Pat. No. Des. 271,220 to Fox, et al. discloses a video game joystick apparatus having a button at the top thereof and a housing below the handle portion having indicia indicative of directions which apparently pertain to a display which directions are controlled by the housing *below* the handle.

U.S. Pat. No. 4,489,303 to Martin is a further example of a joystick controller which is believed to be of only general interest.

SUMMARY OF THE INVENTION

The present invention improves upon the teachings of the prior art discussed hereinabove and provides a carefully integrated and effective joystick control which is applicable to virtually all presently known video game apparatuses. The present invention includes the following interrelated aspects and features:

(a) In the first aspect of the present invention, the joystick control in all aspects thereof is contained within a single housing having a cord connectable to the control circuitry of a video game.

(b) The inventive joystick includes at its uppermost portion a bulbous housing portion having extending upwardly therefrom a joystick control rod. Within the bulbous housing portion, preferably four switches are contained which may be activated through pivoting of the control rod in a desired direction.

(c) The switches are connected and mounted into the bulbous housing portion in such a manner that either one or two switches may be simultaneously actuated, thereby providing eight different directions of movement of the character which is displayed on the video screen.

(d) In a further aspect, the switches are mounted in the bulbous housing portion in such a manner that the lower portions thereof rather than the upper portions thereof move in conjunction with pivoting movements of the joystick control. A spring is provided which connects between a plate carrying the lower portions of the switches and a spring retainer mounted on the control rod.

(e) Depending below the bulbous housing portion is a handle portion which is provided so as to enable the user to grip the joystick control. For this purpose, the handle portion includes several recesses therein provided so as to facilitate the gripping of the handle portion with the fingers. At the uppermost portion of the handle portion directly below the bulbous housing portion, a fire button is provided which may be actuated by the index finger so as to fire "projectiles" or other devices from the character depicted on the video display.

(f) The above-described structure of the present invention completely eliminates the necessity of a cumbersome housing into which a control rod extends since the switches are located in the bulbous housing portion above the handle portion where the joystick control is gripped by the user.

Accordingly, it is a first object of the present invention to provide an improved joystick control.

It is a further object of the present invention to provide such an improved joystick control which has integrally incorporated therein a control rod, switching mechanism, fire button and handle portion.

It is a yet further object of the present invention to provide such a joystick control which completely eliminates the necessity for a cumbersome housing from which a control rod would extend.

It is a still further object of the present invention to provide such a joystick control which has a smoother feel to it as a result of the switching elements being mounted therein in a manner so that the lower portions thereof move rather than the upper portions thereof.

These and other objects, aspects and features of the present invention will be better understood from the following description of the preferred embodiments when read in conjunction with the appended drawing figures.

SPECIFIC DESCRIPTION OF THE PREFERRED EMBODIMENTS

Figure 1:
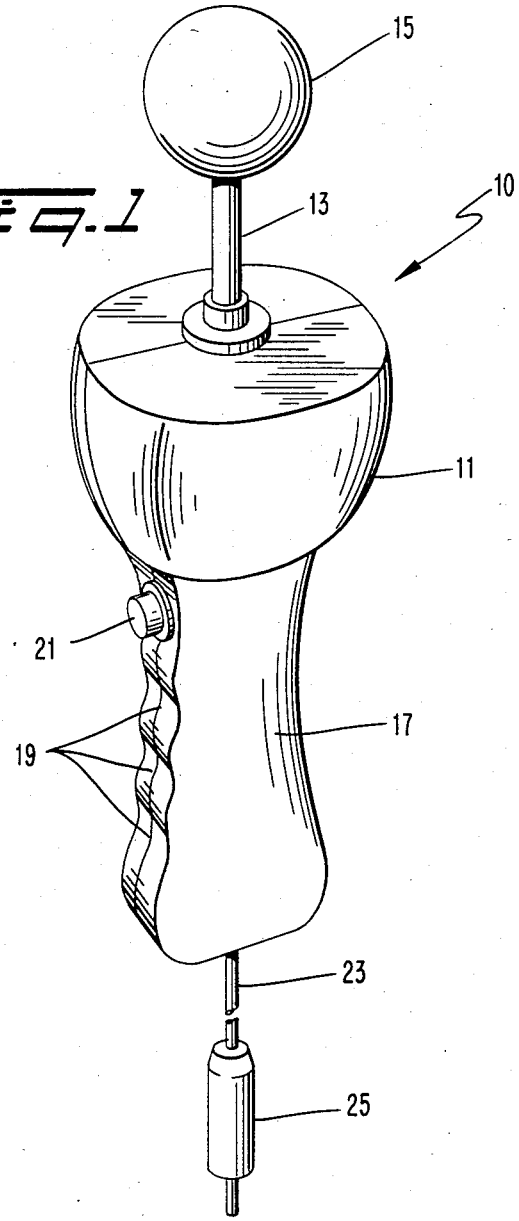
FIG. 1 shows a perspective view of a preferred embodiment of the present invention.

With reference first to FIG. 1, it is seen that the inventive improved joystick control device 10 includes a bulbous housing portion 11, a control rod 13 including a knob 15 at its end, and a handle portion 17. The handle portion 17 includes a plurality of recesses 19 therein which enable the handle portion 17 to be gripped by the fingers of the user thereof. Further, the handle portion 17 includes a fire button 21 which may be pressed by, for example, the index finger of the user so as to enable a projectile or other device to be symbolically fired from the object displayed on the video display which is being controlled by the control rod 13. As further shown in FIG. 1, at the bottom of the handle portion 17, a control cable 23 is provided which has a plug 25 at its end so as to enable the joystick control 10 to be connected into a video game apparatus.

Figure 2:
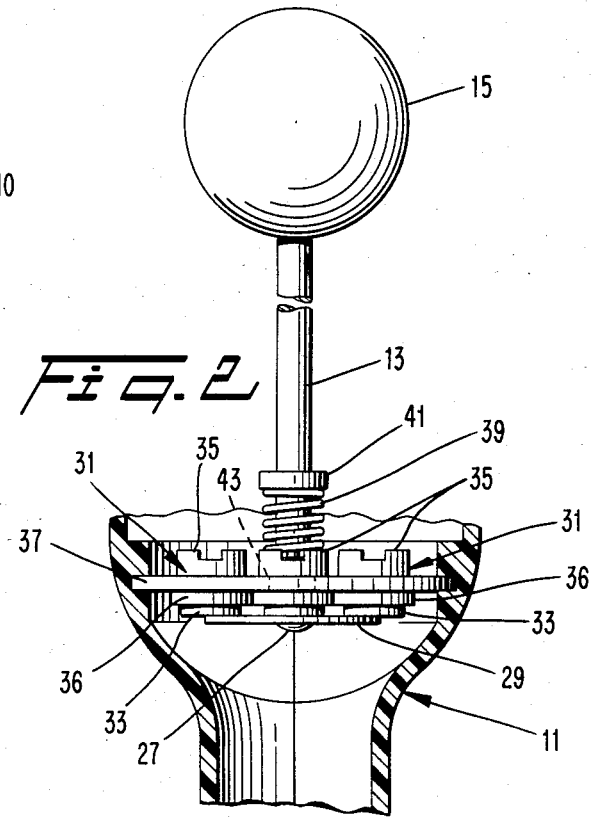
FIG. 2 shows a cross-sectional view through the control rod-switching mechanism of the present invention.
Figure 3:
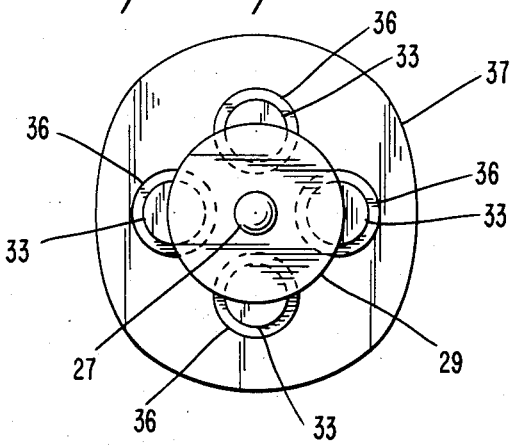
FIG. 3 shows a bottom view of the switching mechanism.
Figure 4:
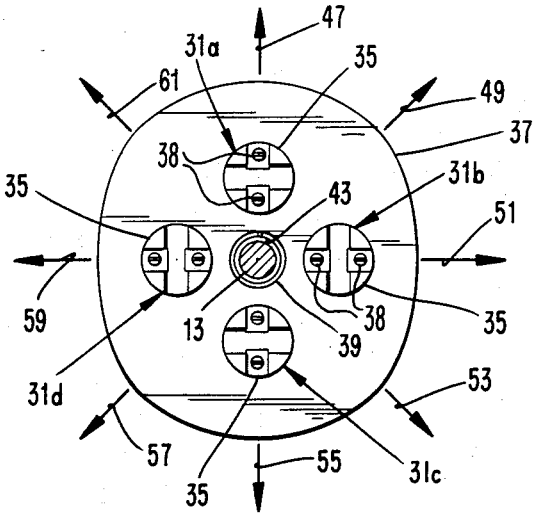
FIG. 4 shows a top view of the switching mechanism.

With reference now to FIGS. 2–4, it is seen that the control rod 13 has a distal end 27 connected to a function plate 29 by any desired means. The function plate 29 engages the respective buttons of a plurality of switches 31, which in the example shown are four in number. The buttons of the switches 31, designated by reference numerals 33, each comprise a push button connected to the switch contacts and resiliently biased so that the switch 31 is normally open.

The respective housings of the switches 31, designated by reference numerals 35, have the terminals 38 for the switch contacts thereon and are rigidly connected to a further function plate 37 by, for example, threaded fasteners 36. The function plate 37, as seen in FIG. 2, is rigidly connected to inner portions of the bulbous housing portion 11. As further seen in FIG. 2, the function plate 29 is not connected to the housing portion 11 but rather floats with respect to the function plate 37. In order that the function plate 29 floats in a controllable manner, a spring 39 is provided which bears upon an upper surface of the function plate 37 at one end thereof and at the other end thereof engages the underside of a spring retainer 41. The control rod 13 extends through an opening 43 provided in the upper function plate 37.

Each of the four switches 31 and the fire button 21 has a positive terminal and a ground terminal. Each of the five ground terminals are connected together through a common ground line which forms one of the wires of the cord 23. The cord 23 includes five additional wires including four individual wires, one for each positive terminal of the switches 31 and one for the positive terminal of the fire button 21. One example of a switch usable for the switches 31 consists of a normally open momentary pushbutton 3 amp 125 volt snap in switch made by G.C. Electronics, Inc., Rockford, Ill., catalogue number 35-423.

in the operation of the switching mechanism of the present invention, reference is made to FIG. 4 which shows eight arrows numbered 47, 49, 51, 53, 55, 57, 59 and 61 respectively. Also, in FIG. 4, each of the switches 31 is more particularly identified by the respective letters a, b, c, and d. In the operation of the switching mechanism shown in FIG. 4, if the control rod 13 is pivoted in the direction of the arrow 47, only the switch 31*c* will be activated. Similarly, respective pivoting of the control rod 13 in the direction of respective arrows 51, 55 or 59 will result in respective singular actuation of the respective switch mechanisms 31*d*, 31*a* and 31*b*. Further, pivoting of the control rod 13 in the direction of the arrow 49 will result in simultaneous actuation of the switches 31*c* and 31*d*. In a corresponding way, respective pivoting of the control rod in the direction of the respective arrows 53, 57 and 61 will respectively cause the simultaneous actuation of respective switches 31*a* and 31*d*, 31*a* and 31*b*, and 31*c* and 31*b*. Accordingly, it should be evident that the present invention, by virtue of its design which allows either one or two switches to be simultaneously actuated, provides for eight different directions of movement of the character which is displayed on the video display. The particular design of the present invention, to wit whereby the pushbuttons 33 of the switches 31 are mounted facing downwardly rather than upwardly has been found by applicant to constitute a superior actuation structure which results in better "feel" in the operation of the control rod 13.

The present invention has been described in terms of a preferred embodiment thereof. It should be understood, however, that various changes, alterations and modifications of the present invention may be contemplated by those skilled in the art without departing from the intended spirit and scope of the present invention. Accordingly, it is stressed that it intended that the present invention only be limited by the terms of the following claims.

I claim:

1. An improved joystick control device comprising:

(a) an upper housing portion;

(b) a control rod extending upwardly from said upper housing portion;

(c) a hand grip held housing portion depending downwardly from said upper housing portion; and (d) switch means in said upper housing portion, said switch means having actuating means facing downwardly in a direction substantially opposite to the direction of elongation of said control rod and operatively connected to said control rod by a movable plate means whereby controlled movement of said control rod selectively actuates said switch means.

2. The invention of claim 1, wherein said upper housing portion is bulbous.

3. The invention of claim 1, wherein said hand grip held housing portion has a fire button mounted thereto.

4. The invention of claim 1, wherein said switch means includes at least one switch device including:

(a) a switch housing fixedly connected to said upper housing portion; and (b) a pushbutton comprising said actuating means and operatively connected to said rod.

5. The invention of claim 4, wherein said switch means comprises four such switch devices, the respective switch housings thereof being mounted on a top function plate and the pushbuttons thereof being engaged to a bottom function plate comprising said movable plate means, said top function plate being fixedly connected to said upper housing portion and said control rod being rigidly connected to said bottom function plate.

6. The invention of claim 5, wherein each said push button is resiliently biased in a direction opening each said switch device.

7. The invention of claim 5, wherein said top function plate has a hole therethrough through which said control rod extends.

8. The invention of claim 7, further including a spring mounted between said top function plate and a retainer mounted on said control rod above said top function plate.

9. A switch mechanism for a joystick comprising:

(a) a housing portion;

(b) a top plate fixedly mounted to said housing portion;

(c) a control rod;

(d) a bottom plate rigidly connected to said control rod;

(e) said top plate having a hole therethrough through which said control rod extends; and (f) a plurality of switches, each of said switches including a switch housing inversely mounted to said top plate in a direction opposite to the direction of elongation of said control rod and a pushbutton engaging said bottom plate.

10. The invention of claim 9, wherein said plurality of switches includes four switches.

11. The invention of claim 9, wherein said control rod includes a retainer thereon above said top plate and further including spring means interposed between said top plate and said retainer.

12. The invention of claim 9, wherein each said pushbutton is resiliently biased to an open position of said switch.

* * * * *